US011102586B2

(12) United States Patent
Zou et al.

(10) Patent No.: US 11,102,586 B2
(45) Date of Patent: Aug. 24, 2021

(54) MEMS MICROPHONE

(71) Applicants: Goertek, Inc., Weifang (CN); Qingdao Research Institute of Beihang University, Shandong (CN)

(72) Inventors: Quanbo Zou, Weifang (CN); Qunwen Leng, Weifang (CN); Zhe Wang, Weifang (CN)

(73) Assignee: Weifang Goertek Microelectronics Co., Ltd., Shandong (CN)

( * ) Notice: Subject to any disclaimer, the term of this patent is extended or adjusted under 35 U.S.C. 154(b) by 0 days.

(21) Appl. No.: 16/640,022

(22) PCT Filed: Sep. 6, 2018

(86) PCT No.: PCT/CN2018/104442

§ 371 (c)(1),
(2) Date: Feb. 18, 2020

(87) PCT Pub. No.: WO2020/000651

PCT Pub. Date: Jan. 2, 2020

(65) Prior Publication Data

US 2020/0267480 A1 Aug. 20, 2020

(30) Foreign Application Priority Data

Jun. 25, 2018 (CN) ..... 201810663424.4

(51) Int. Cl.
*H04R 19/04* (2006.01)

(52) U.S. Cl.
CPC ..... *H04R 19/04* (2013.01); *H04R 2201/003* (2013.01)

(58) Field of Classification Search
CPC .... B81B 2201/0257; B81B 2201/0264; B81B 2203/0127; B81B 2207/012; B81B 7/008;
(Continued)

(56) References Cited

U.S. PATENT DOCUMENTS 5,450,372 A * 9/1995 Jin ..... H04R 21/02 367/140
8,582,788 B2 * 11/2013 Leidl ..... H04R 1/2838 381/173

(Continued)

FOREIGN PATENT DOCUMENTS

CN 103686566 A 3/2014
JP 2010045430 A 2/2010
WO WO2007117198 A1 10/2007

*Primary Examiner* — Akelaw Teshale
(74) *Attorney, Agent, or Firm* — Baker Botts, L.L.P.

(57) ABSTRACT

An MEMS microphone is provided, comprising a first substrate and a vibration diaphragm supported above the first substrate by a spacing portion, the first substrate, the spacing portion, and the vibration diaphragm enclosing a vacuum chamber, and a static deflection distance of the vibration diaphragm under an atmospheric pressure being less than a distance between the vibration diaphragm and the first substrate, wherein: one of the vibration diaphragm and the first substrate is provided with a magnetic film, and the other one of the vibration diaphragm and the first substrate is provided with a magnetoresistive sensor cooperating with the magnetic film, the magnetoresistive sensor being configured to sense a change in a magnetic field of the magnetic film during a vibration of the vibration diaphragm and output a varying electrical signal.

9 Claims, 4 Drawing Sheets

(58) Field of Classification Search
CPC ..... B81B 7/0048; H04R 2201/003; H04R 19/005; H04R 19/04; H04R 17/00; H04R 1/04; H04R 1/1083; H04R 2499/11; H04R 1/406; H04R 2201/401; H04R 2420/07; H04R 31/00; H04R 5/027; H04R 5/033; H04R 17/02; H04R 1/24; H04R 2410/05; H04R 7/04; H04R 31/003; H04R 9/08; H04R 1/08; H04R 1/265; H04R 1/46; H04R 2217/01; H04R 23/02; H04R 2410/00; H04R 7/18; H04R 2410/03; H04R 7/10; H04R 23/00; H04R 19/02; H04R 25/505; H04R 25/554; H04R 1/023; H04R 1/1008; H04R 1/1091; H04R 2225/025; H04R 2400/01; H04R 2460/01; H04R 25/606; H04R 29/00; H04R 3/005; H04R 5/02; H04R 9/025; H04R 19/00; H04R 1/025; H04R 1/1016; H04R 1/1041; H04R 1/1075; H04R 1/403; H04R 2460/13; H04R 25/405; H04R 25/407; H04R 29/001; H04R 7/06; H04R 9/063; H04R 15/00; H04R 19/016; H04R 1/02; H04R 1/083; H04R 1/323; H04R 2201/107; H04R 2201/405; H04R 2203/12; H04R 2225/023; H04R 2225/39; H04R 2225/51; H04R 2225/55; H04R 2225/61; H04R 2225/67; H04R 23/002; H04R 2410/07; H04R 2430/01; H04R 2430/20; H04R 2440/01; H04R 2460/05; H04R 2460/07; H04R 2460/09; H04R 2460/11; H04R 25/00; H04R 25/02; H04R 25/30; H04R 25/43; H04R 25/453; H04R 25/552; H04R 25/604; H04R 25/609; H04R 25/656; H04R 27/00; H04R 3/00; H04R 3/002; H04R 3/007; H04R 3/02; H04R 3/04; H04R 3/12; H04R 3/14; H04R 5/04; H04R 7/26; H04R 9/00; H04R 9/06
See application file for complete search history.

(56) References Cited

U.S. PATENT DOCUMENTS

| | | | | |
|---|---|---|---|---|
| 2002/0178831 | A1* | 12/2002 | Takada | H03H 9/462 |
| 2007/0209437 | A1* | 9/2007 | Xue | G01C 19/56 73/514.31 |
| 2014/0254835 | A1* | 9/2014 | Yakura | H04R 19/005 381/120 |
| 2018/0352341 | A1* | 12/2018 | Reinmuth | H04R 7/04 |
| 2019/0116429 | A1* | 4/2019 | Meisel | B81B 7/0061 |
| 2019/0241429 | A1* | 8/2019 | Suvanto | B81B 7/02 |
| 2019/0352176 | A1* | 11/2019 | Doller | B81B 7/0048 |
| 2019/0389721 | A1* | 12/2019 | Doller | B81B 3/0021 |

* cited by examiner

MEMS MICROPHONE

CROSS-REFERENCE TO RELATED APPLICATIONS

This application is a National Stage of International Application No. PCT/CN2018/104442, filed on Sep. 6, 2018, which claims priority to Chinese Patent Application No. 201810663424.4, filed on Jun. 25, 2018, both of which are hereby incorporated by reference in their entireties.

TECHNICAL FIELD

The present disclosure relates to the field of acoustic-electric conversion, and more particularly to an MEMS (micro electro-mechanical systems) microphone, especially a microphone structure with a high SNR (signal-to-noise ratio).

BACKGROUND

Currently, prevailing MEMS microphones each comprise a capacitive sensing structure, including a substrate, a backplate and a vibration diaphragm which are formed on the substrate, the backplate and the vibration diaphragm with a gap therebetween forming a plate-type capacitor sensing structure.

In order to improve the mechanical sensitivity of the vibration diaphragm, the microphone is designed with a large back cavity with an ambient pressure, to ensure that the rigidity of flowing air is much smaller than that of the vibration diaphragm. A volume of the back cavity is generally much greater than 1 $mm^3$, and typically designed to be for example 1-15 $mm^3$. Moreover, a cavity of a microphone chip is required to be open when the microphone chip is packaged, which limits a minimum package size of the MEMS microphone (>3 $mm^3$).

The reason is that if the volume of the back cavity is too small, a circulation of air is adversely blocked, and the rigidity of air will greatly reduce the mechanical sensitivity of the vibration diaphragm. In addition, for pressure equalization, dense perforation holes are usually designed in the backplate, and the air flow resistance in the gap or perforation holes caused by air viscosity becomes a dominant factor of the MEMS microphone noise, thereby restrict a high signal-to-noise ratio performance of the microphone.

SUMMARY

An object of the present disclosure is to provide a novel technical solution of an MEMS microphone.

According to the first aspect of the present disclosure, there is provided an MEMS microphone, comprising a first substrate and a vibration diaphragm supported above the first substrate by a spacing portion, the first substrate, the spacing portion, and the vibration diaphragm enclosing a vacuum chamber, and a static deflection distance of the vibration diaphragm under an atmospheric pressure being less than a distance between the vibration diaphragm and the first substrate, wherein: one of the vibration diaphragm and the first substrate is provided with a magnetic film, and the other one of the vibration diaphragm and the first substrate is provided with a magnetoresistive sensor cooperating with the magnetic film, the magnetoresistive sensor being configured to sense a change in a magnetic field of the magnetic film during a vibration of the vibration diaphragm and output a varying electrical signal.

Optionally, the magnetoresistive sensor s a giant magnetoresistive sensor or a tunnel magnetoresistive sensor.

Optionally, the magnetic film is provided on a side of the first substrate that is adjacent to the vacuum chamber; and the magnetoresistive sensor is provided on s side of the vibration diaphragm that is adjacent to or away from the vacuum chamber.

Optionally, the magnetic film is provided on a side of the first substrate that is adjacent to the vacuum chamber; and the vibration diaphragm comprises a composite structure, the magnetoresistive sensor being provided in the composite structure of the vibration diaphragm.

Optionally, the magnetoresistive sensor is provided on a side of the first substrate that is adjacent to the vacuum chamber; and the magnetic film is provided on a side of the vibration diaphragm that is adjacent to or away from the vacuum chamber.

Optionally, the magnetoresistive sensor is provided on a side of the first substrate that is adjacent to the vacuum chamber; and the vibration diaphragm comprises a composite structure, the magnetic film being provided in the composite structure of the vibration diaphragm.

Optionally, the vibration diaphragm has a mechanical sensitivity of 0.02 to 0.9 nm/Pa, and an initial gap between the vibration diaphragm and the first substrate is 1-100 μm.

Optionally, the MEMS microphone further comprises an ASIC circuit formed on the first substrate.

Optionally, a second substrate is provided on a side of the vibration diaphragm that is away from the vacuum chamber, and an opening exposing the vibration diaphragm is formed on the second substrate at a position corresponding to a central region of the vibration diaphragm.

According to the MEMS microphone of the disclosure, the vacuum chamber enclosed between the vibration diaphragm and the first substrate, and the air viscosity in the vacuum chamber is much lower than the air viscosity at the ambient pressure, thereby reducing an influence of acoustic resistance on a vibration of the vibration diaphragm, and increasing a signal-to-noise ratio of the microphone. In addition, since such an MEMS microphone does not have a back cavity with a relatively large volume, an overall size of the MEMS microphone can be greatly reduced, and the reliability of the microphone is improved.

Further features of the present disclosure and advantages thereof will become apparent from the following detailed description of exemplary embodiments according to the present disclosure with reference to the attached drawings.

BRIEF DESCRIPTION OF THE DRAWINGS

The accompanying drawings, which are incorporated in and constitute a part of the specification, illustrate embodiments of the disclosure and, together with the description thereof, serve to explain the principles of the disclosure.

DETAILED DESCRIPTION

Technical problems to be solved, technical solutions to be adopted, and technical effects to be obtained by the present disclosure are to be easily understood from the further detailed description of particular embodiments according to the present disclosure in conjunction with the attached drawings.

Figure 1:
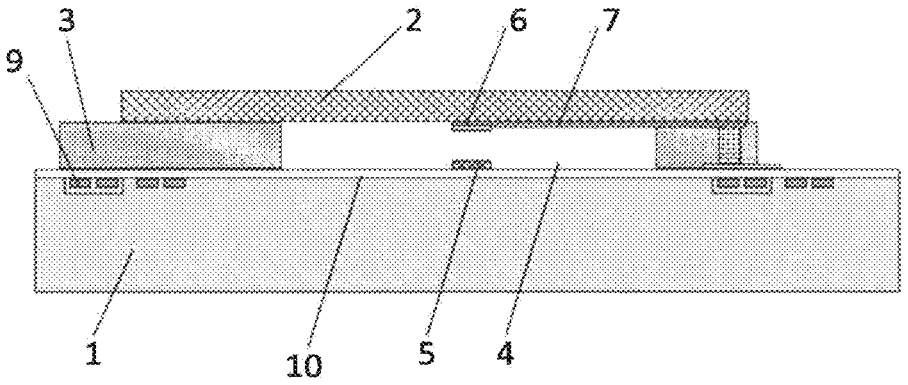
FIG. 1 is a schematic structural view of a first embodiment of a microphone of the present disclosure.

Referring to FIG. 1, the present disclosure provides an MEMS microphone comprising a first substrate 1 and a vibration diaphragm 2 supported above the first substrate 1 by a spacing portion 3. The first substrate 1, the spacing portion 3, and the vibration diaphragm 2 enclose a vacuum chamber 4.

The first substrate 1 according to the present disclosure may be made of monocrystalline or other materials well known to those skilled in the art. The spacing portion 3 and the vibration diaphragm 2 supported on the substrate 1 by the spacing portion 3 may be formed by depositing layer by layer, patterning and sacrificial processes. The vacuum chamber 4 may be sealed by for example low pressure plasma enhanced chemical vapor deposition (PECVD) at 200-350° C. Such MEMS manufacturing processes belongs to common general knowledge of those skilled in the art and will not be specifically explained herein. The vacuum chamber 4 has a pressure preferably lower than 1 kPa, such that the air viscosity of residual air in the vacuum chamber 4 is much lower than the air viscosity of air at a standard pressure.

Since the vacuum chamber with the pressure smaller than an atmospheric pressure is formed between the vibration diaphragm 2 and the first substrate 1, the vibration diaphragm 2 is statically deflected under the atmospheric pressure and without a sound pressure, that is, the vibration diaphragm 2 is statically deflected toward the first substrate 1. In order to prevent the vibration diaphragm 2 from being deflected to get into contact with the first substrate 1 when the vibration diaphragm 2 is static, a static deflection distance of the vibration diaphragm 2 is designed to be less than a distance between the vibration diaphragm 2 and the first substrate 1, which can be achieved mainly by changing the rigidity of the vibration diaphragm 2 and/or the distance between the vibration diaphragm 2 and the first substrate 1.

For example, the thickness of the vibration diaphragm 2 may be increased, and of course the rigidity of the vibration diaphragm 2 can also be improved by selecting a suitable material for the vibration diaphragm 2. For example, the vibration diaphragm 2 may be designed to have the mechanical sensitivity of 0.02 to 0.9 nm/Pa. That is to say, each time a pressure of 1 Pa is applied, the vibration diaphragm 2 will have a deflection of 0.02-0.9 nm. The vibration diaphragm 2 is 10-100 times as rigid as the conventional vibration diaphragm, so that the vibration diaphragm 2 is rigid enough to resist the atmospheric pressure in an ambient environment.

An initial gap between the vibration diaphragm 2 and the first substrate 1 may be designed in the range of 1-100 μm, such that the rigid vibration diaphragm 2 will not collapse under the atmospheric pressure.

In order to improve the sensitivity of the MEMS microphone, the MEMS microphone may adopt a highly-sensitive detection member. In a specific embodiment of the present disclosure, the highly-sensitive detection member may adopt a magnetoresistive sensor 6, such as a giant magnetoresistive sensor (GMR) or a tunnel magnetoresistive sensor (TMR), outputting an electrical signal as a function of a change in a magnetic field. An influence of the rigid vibration diaphragm on the overall sensitivity of the microphone can be compensated by using the highly-sensitive magnetoresistive sensor to acquire the detected electrical signal, and the acoustic performance of the thin and light microphone is ensured.

Referring to FIG. 1, a magnetic film 5 is provided on a side of the first substrate 1 that is adjacent to the vacuum chamber 4. The magnetic film 5 may directly be made of a magnetic material, or the film may be magnetized after the being formed. In a specific embodiment of the present disclosure, the magnetic film 5 may be made of a CoCrPt or CoPt material.

The magnetic film 5 may be formed on the first substrate 1 by depositing or other means well known to those skilled in the art. Specifically, during manufacturing, an insulating layer 10 may be firstly deposited on the first substrate 1, and then the magnetic film 5 is formed by depositing and patterning treatments. In order to protect the magnetic film 5, a passivation layer covering the magnetic film 5 may be deposited on the insulating layer 10. The insulating layer and the passivation layer may be made of materials well known to those skilled in the art, which will not be specifically explained herein.

Referring to the embodiment of FIG. 1, the magnetoresistive sensor 6 is provided on a side of the vibration diaphragm 2 that is adjacent to the vacuum chamber, and the magnetoresistive sensor 6 is provided at a position corresponding to the magnetic film 5 on the first substrate 1. In order to transmit the electrical signal from the magnetoresistive sensor 6 onto the first substrate 1, a lead portion 7 may be provided on a side of the vibration diaphragm 2 that is adjacent to the vacuum chamber, and one end of the lead portion 7 is connected to the magnetoresistive sensor 6. The other end of the lead portion 7 extends on the vibration diaphragm 2 to the spacing portion 3 and is connected to a bonding pad or circuit layout of the first substrate 1 through a conductive structure provided in the spacing portion 3.

Figure 7:
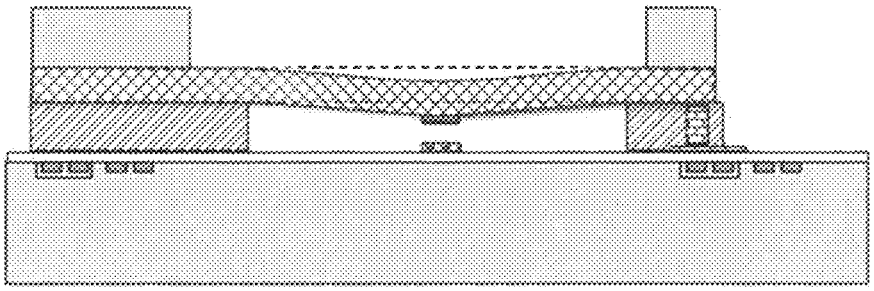
FIG. 7 is a schematic view of a working principle of the microphone of the present disclosure.

Referring to FIG. 7, when the vibration diaphragm 2 is subjected to an external sound pressure, the vibration diaphragm 2 is deformed toward the first substrate 1. Then, the magnetoresistive sensor 6 on the vibration diaphragm 2 approaches the magnetic film 5, such that the magnetoresistive sensor 6 can sense the change in the magnetic field to output a varying electrical signal and realize an acoustic-electric conversion.

According to the MEMS microphone of the present disclosure, the vacuum chamber is enclosed between the vibration diaphragm 2 and the first substrate 1, and the air viscosity in the vacuum chamber is much lower than the air viscosity at the ambient pressure, thereby reducing an influence of the acoustic resistance on a vibration of the vibration diaphragm 2 and increasing a signal-to-noise ratio of the microphone. In addition, since such an MEMS microphone does not have a back cavity with a relatively large volume, an overall size of the MEMS microphone can be greatly reduced, and the reliability of the microphone is improved.

Figure 2:
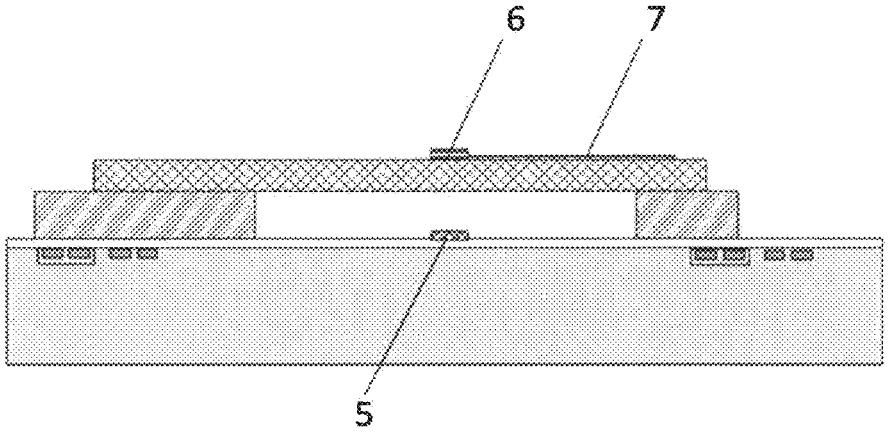
FIG. 2 is a schematic structural view of a second embodiment of the microphone of the present disclosure.

Referring to the embodiment of FIG. 2, in the present embodiment, the magnetoresistive sensor 6 is provided on a side of the vibration diaphragm 2 that is away from the vacuum chamber 4. The magnetoresistive sensor 6 is provided on an outer or upper side of the vibration diaphragm 2 as seen in a view direction in FIG. 2. Although the vibration diaphragm 2 is interposed between the magnetoresistive sensor 6 and the magnetic film 5, the magnetic field of the magnetic film 5 can pass through the vibration diaphragm 2 and is sensed by the magnetoresistive sensor 6, and thus the performance of the MEMS microphone is not affected.

Figure 3:
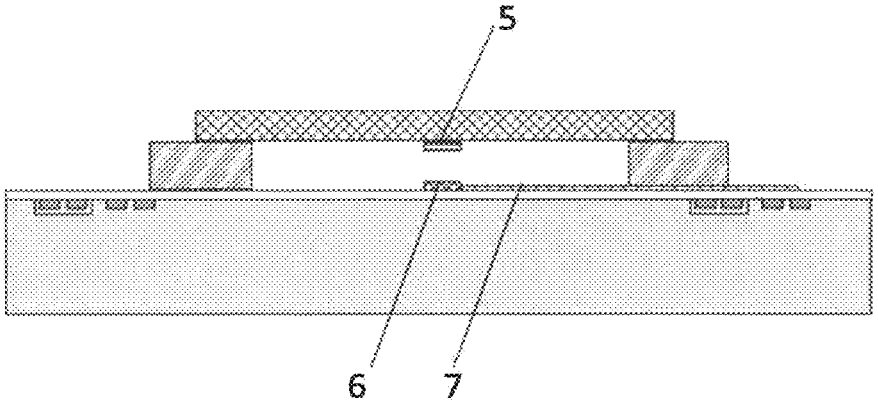
FIG. 3 is a schematic structural view of a third embodiment of the microphone of the present disclosure.
Figure 4:
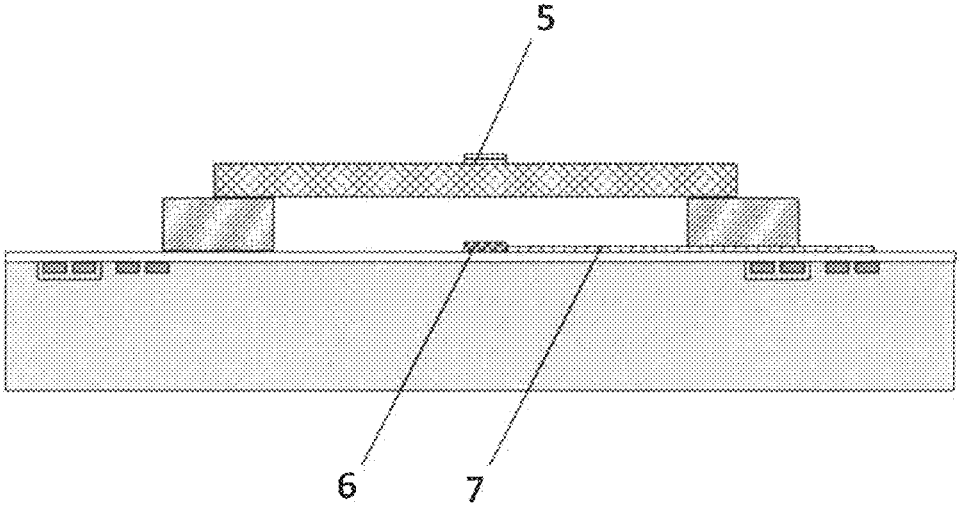
FIG. 4 is a schematic structural view of a fourth embodiment of the microphone of the present disclosure.

The magnetic film 5 can also be provided on the vibration diaphragm 2 and the magnetoresistive sensor 6 is provided on the first substrate 1. Referring to the embodiment shown in FIG. 3, the magnetoresistive sensor 6 is provided on a side of the first substrate 1 that is adjacent to the vacuum chamber 4, and the magnetic film 5 is, provided on a side of the vibration diaphragm 2 that is adjacent to the vacuum chamber 4. The magnetoresistive sensor 6 is provided at a position corresponding to the magnetic film 5, so that the magnetoresistive sensor 6 is located in such a way that it is highly-sensitive to the change in the magnetic field. In the embodiment shown in FIG. 4, the magnetic film 5 is provided at a side of the vibration diaphragm 2 that is away from the vacuum chamber 4, and in other words, the magnetic film 5 is provided on an outer or upper side of the vibration diaphragm 2.

Since the magnetoresistive sensor 6 is provided on the first substrate 1, one end of the lead portion 7 is connected to the magnetoresistive sensor 6, and the other end of the lead portion 7 directly extends to a corresponding bonding pad or pin of the first substrate 1, so as to electrically connect the magnetoresistive sensor 6 to the circuit layout of the first substrate 1.

Figure 5:
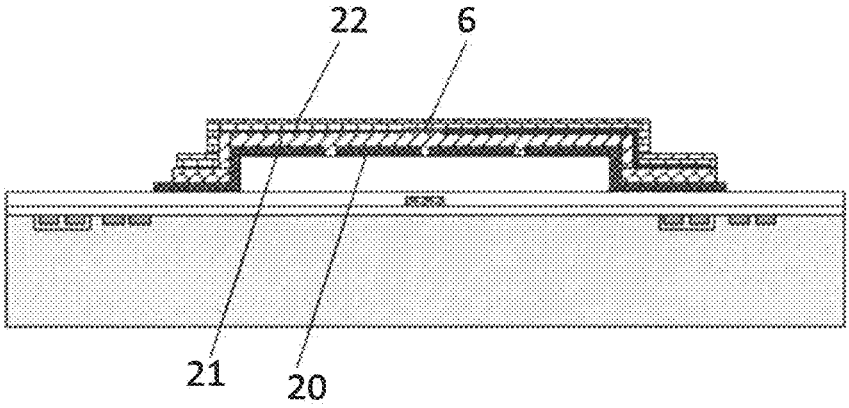
FIG. 5 schematic structural view of a fifth embodiment of the microphone of the present disclosure.

In an optional embodiment of the present disclosure, the vibration diaphragm 2 may adopt a composite structure. Referring to FIG. 5, for example, in order to form the vacuum chamber, a covering layer 20 having sacrificial holes is firstly provided on a sacrificial layer, and the sacrificial layer below the covering layer 20 is etched off through the sacrificial holes. A filling layer 21 is then deposited above the covering layer 20 to close the sacrificial holes in the covering layer 20 to form the vacuum chamber.

In the above embodiment, the magnetoresistive sensor 6 or the magnetic film 5 may be provided on the filling layer 21, and finally a passivation layer 22 is deposited for protection. The magnetoresistive sensor 6 or the magnetic film 5 is formed in the composite structure of the vibration diaphragm 2.

It should be noted that in the highly-sensitive detection remember of each embodiment of the present disclosure, one magnetoresistive sensor 6 or one magnetic film 5 may be provided; or a plurality of magnetoresistive sensors 6 or magnetic films 5 may be provided and arranged in an array to improve performance of the detection member.

Figure 6:
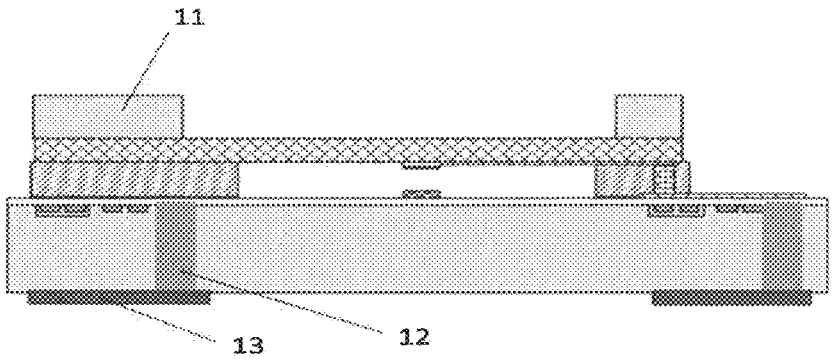
FIG. 6 is a schematic structural view of a sixth embodiment of the microphone of the present disclosure.

The MEMS microphone of the present disclosure can also be manufactured by bonding in addition to surface micromachining or bulk silicon micromachining. Referring to FIG. 6, a second substrate 11 is provided on a side of the vibration diaphragm 2 that is away from the vacuum chamber 4, and an opening exposing the vibration diaphragm 2 is provided on the second substrate 11 at a position corresponding to a central region of the vibration diaphragm 2.

Figure 8:
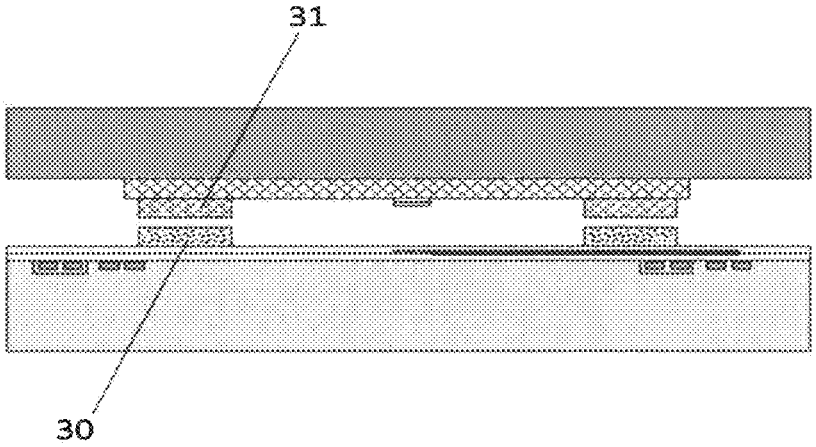
FIG. 8 is a schematic view of one of manufacturing processes for the microphone of the present disclosure.

Referring to FIG. 8, during the manufacturing, by for example surface micromachining or bulk silicon micromachining, the magnetoresistive sensor 6 and a first spacing portion 30 are formed on the first substrate, and the vibration diaphragm 2, the magnetic film 5 on the vibration diaphragm 2 and a second spacing portion 31 are formed on the second substrate. Then the first spacing portion 30 and the second spacing portion 31 are bonded together by bonding, and finally the second substrate is processed. The second substrate may be completely removed, or formed as shown in FIG. 6 to protect the vibration diaphragm 2 and improve the mounting flexibility of the microphone.

In an optional embodiment of the present disclosure, referring to FIG. 1, an ASIC circuit 9 of the microphone may be integrated on the first substrate 1, and the magnetoresistive sensor 6 may be electrically connected to the ASIC circuit 9 via the circuit layout on or in the first substrate 1, so that the electrical signal output by the magnetoresistive sensor 6 can be processed by the ASIC circuit 9.

As the MEMS microphone according to the present disclosure does not have the back cavity with the relatively large volume, a wafer level package (WLP) can be completely adopted, and the microphone can be directly mounted on an external terminal without a conventional PCB board package. In a specific embodiment of the present disclosure as shown in FIG. 6, a bonding pad 13 is formed at an end of the first substrate 1 that is away from the vacuum chamber 4, and the electrical signal from the first substrate 1 may be transmitted onto the bonding pad 13 via a metalized perforation hole 12, so that the MEMS microphone can be mounted directly via the bonding pad 13.

Figure 9:
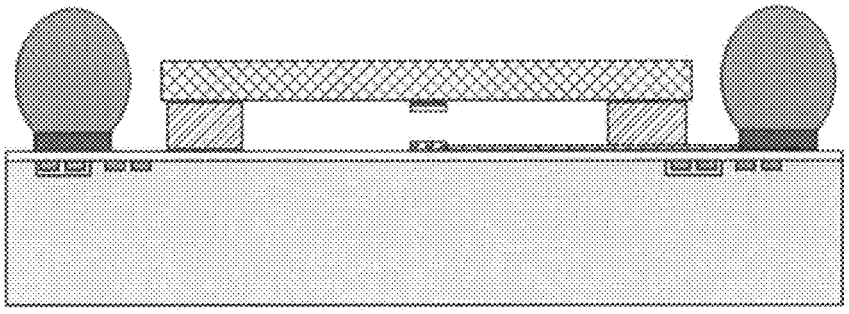
FIG. 9 is a schematic view of one packaging manners for the microphone of the present disclosure.

In another specific embodiment of the present disclosure as shown in FIG. 9, pins are formed on an upper surface of the first substrate (that is adjacent to the vibration diaphragm), and the microphone can be directly mounted on the external terminal by projection welding (solder ball mounting).

Of course, the MEMS microphone according to the present disclosure may also adopt a conventional package structure, for example, a package structure defined by a circuit board and a shell is provided. The MEMS microphone is mounted in the package structure to form a conventional top or bottom package structure, and is finally mounted on the external terminal in the form of a microphone module.

The present disclosure has been explained in detail by the preferred embodiments. However, variations and additions on the various embodiments are obvious for those ordinary skilled in the art by reading the foregoing context. The applicant intends to include all such variations and additions within the scope of claims of the present disclosure.

Similar numerals refer to similar elements in the text. For the sake of clarity, some of the lines, layers, elements, components or features may be enlarged in the drawings.

The terms used herein are merely for the purpose of illustrating specific embodiments rather than limiting the present disclosure. Unless otherwise defined, all terms (including technical terms and scientific terms) used herein are the same as those understood by the ordinary skilled in the art of the present disclosure.

The invention claimed is:

1. An MEMS microphone, comprising a first substrate and a vibration diaphragm supported above the first substrate by a spacing portion, the first substrate, the spacing portion, and the vibration diaphragm enclosing a vacuum chamber, wherein a static deflection distance of the vibration diaphragm under an atmospheric pressure comprises less than a distance between the vibration diaphragm and the first substrate, wherein:

a first of the vibration diaphragm and the first substrate is provided with a magnetic film, and a second of the vibration diaphragm and the first substrate is provided with a magnetoresistive sensor cooperating with the magnetic film, the magnetoresistive sensor being configured to sense a change in a magnetic field of the magnetic film during a vibration of the vibration diaphragm and output a varying electrical signal.

2. The MEMS microphone according to claim 1, wherein the magnetoresistive sensor is a giant magnetoresistive sensor or a tunnel magnetoresistive sensor.

3. The MEMS microphone according to claim 1, wherein the magnetic film is provided on a side of the first substrate that is adjacent to the vacuum chamber; and the magnetoresistive sensor is provided on the side of the vibration diaphragm that is adjacent to the vacuum chamber or on a side of the vibration diaphragm that is away from the vacuum chamber.

4. The MEMS microphone according to claim 1, wherein the magnetic film is provided on a side of the first substrate that is adjacent to the vacuum chamber; and the vibration diaphragm comprises a composite structure, the magnetoresistive sensor being provided in the composite structure of the vibration diaphragm.

5. The MEMS microphone according to claim 1, wherein the magnetoresistive sensor is provided on a side of the first substrate that is adjacent to the vacuum chamber; and the magnetic film is provided on the side of the vibration diaphragm that is adjacent to the vacuum chamber or on a side of the vibration diaphragm that is away from the vacuum chamber.

6. The MEMS microphone according to claim 1, wherein the magnetoresistive sensor is provided on a side of the first substrate that is adjacent to the vacuum chamber; and the vibration diaphragm comprises a composite structure, the magnetic film being provided in the composite structure of the vibration diaphragm.

7. The MEMS microphone according to claim 1, wherein the vibration diaphragm has a mechanical sensitivity of 0.02 to 0.9 nm/Pa, and an initial gap between the vibration diaphragm and the first substrate is 1-100 μm.

8. The MEMS microphone according to claim 1, further comprising an ASIC circuit formed on the first substrate.

9. The MEMS microphone according to claim 1, wherein a second substrate is provided on a side of the vibration diaphragm that is away front the vacuum chamber, and an opening exposing the vibration diaphragm is formed on the second substrate at a position corresponding to a central region of the vibration diaphragm.

* * * * *